United States Patent [19]

Nace

[11] Patent Number: 4,784,745

[45] **Date of Patent: * Nov. 15, 1988**

[54] CATALYTIC UPGRADING OF FCC EFFLUENT

[75] Inventor: Donald M. Nace, Woodbury, N.J.

[73] Assignee: Mobil Oil Corporation, New York, N.Y.

[ * ] Notice: The portion of the term of this patent subsequent to Jun. 28, 2005 has been disclaimed.

[21] Appl. No.: 122,477

[22] Filed: Nov. 5, 1987

Related U.S. Application Data

[63] Continuation of Ser. No. 54,062, May 18, 1987, abandoned, Continuation-in-part of Ser. No. 796,045, Nov. 7, 1985, abandoned.

[51] Int. Cl.[4] ..... C10G 51/02

[52] U.S. Cl. ..... 208/74; 208/49; 208/61; 208/70; 208/75; 208/100

[58] Field of Search ..... 208/74, 67, 75, 155, 208/18, 85, 97, 68, 70, 120, 49, 46, 100

[56] References Cited

U.S. PATENT DOCUMENTS

| | | | |
|---|---|---|---|
| 3,649,521 | 3/1972 | Martin | 208/74 |
| 3,748,251 | 7/1973 | Demmel et al. | 208/74 |
| 3,756,942 | 9/1973 | Cattanach | 208/137 |
| 3,758,403 | 9/1973 | Rosinski et ala. | 208/120 |
| 3,760,024 | 9/1973 | Cattanach | 260/673 |
| 3,769,202 | 10/1973 | Plank et al. | 208/111 |
| 3,894,931 | 7/1975 | Nace et al. | 208/73 |
| 3,894,933 | 7/1975 | Owen et al. | 208/77 |
| 3,894,934 | 7/1975 | Owen et al. | 208/78 |
| 3,926,778 | 12/1975 | Owen et al. | 208/74 |
| 3,950,242 | 4/1976 | Garwood et al. | 208/70 |
| 4,001,106 | 1/1977 | Plank et al. | 208/75 |
| 4,032,432 | 6/1977 | Owen | 208/74 |
| 4,097,367 | 6/1978 | Haag et al. | 208/135 |
| 4,176,049 | 11/1979 | Winter et al. | 208/70 |
| 4,309,279 | 1/1982 | Chester et al. | 208/120 |
| 4,309,280 | 1/1982 | Rosinski et al. | 208/120 |
| 4,368,114 | 1/1983 | Chester et al. | 208/120 |
| 4,490,241 | 12/1984 | Chou | 208/75 |
| 4,560,536 | 12/1985 | Tabak | 208/70 |
| 4,591,425 | 5/1986 | Kovach et al. | 208/74 |

OTHER PUBLICATIONS

Considine, Douglas M., Editor-in-Chief, *Energy Technology Handbook*, McGraw Hill Book Co., 1977, pp. 3-231 to 3-233.

*Primary Examiner*—Anthony McFarlane
*Attorney, Agent, or Firm*—Alexander J. McKillop; Michael G. Gilman; Malcolm D. Keen

[57] ABSTRACT

An apparatus and process for catalytically upgrading an FCC effluent is described, wherein the FCC effluent is contacted with a shape-selective catalyst at low severity conditions prior to fractionation.

30 Claims, 1 Drawing Sheet

CATALYTIC UPGRADING OF FCC EFFLUENT

This is a continuation of copending application Ser. No. 054,062, filed on May 18, 1987, now abandoned, which is a continuation-in-part of U.S. patent application Ser. No. 796,045, filed 11/7/85, now abandoned.

BACKGROUND OF THE INVENTION

1. Field of the Invention

This invention is directed to the catalytic cracking of petroleum fractions, and specifically to an improved process and an apparatus for increasing gasoline octane number and reducing the pour point of light distillate oils. More specifically, this invention is directed to a process for improving the octane number and pour point of gasoline and light distillate oil, respectively, which are produced in a Fluid Catalytic Cracking unit.

2. Description of the Prior Art

Hydrocarbon conversion processes utilizing crystalline zeolites are well known in the art. Crystalline zeolites have been found to be particularly effective for a wide variety of hydrocarbon conversion processes, including the catalytic cracking of a gas oil to produce motor fuels, and having been described and claimed in many patents, including U.S. Pat. Nos. 3,140,249; 3,140,251, 3,140,252; 3,140,253; and 3,271,418. It is also known in the prior art to incorporate the crystalline zeolite into a matrix for catalytic cracking, and such disclosure appears in one or more of the above-identified U.S. patents.

A dominant process in the field of catalytic cracking using crystalline zeolites is Fluid Catalytic Cracking (hereinafter FCC). This process is so named because the catalyst is in the form of spray-dried microspheres having an average size of 60 microns in diameters. When suspended in an oil vapor or gas, the microspheres act like a fluid.

An FCC reactor typically comprises a thermally balanced apparatus assembly which includes a reactor vessel containing a mixture of regenerated catalyst and the feed, and a regenerator vessel wherein spent catalyst is regenerated. The feed is converted in the reactor vessel over the catalyst, and coke simultaneously forms on the catalyst, thereby deactivating the same. The deactivated (spent) catalyst is removed from the reactor vessel and conducted to the regenerator vessel, wherein coke is burned off the catalyst with air, thereby regenerating the catalyst. The regenerated catalyst is then recycled to the reactor vessel. The reactor-regenerator assembly must be maintained in steady state heat balance so that the heat generated by burning the coke provides sufficient thermal energy for catalytic cracking in the reactor vessel. The steady state heat balance is usually achieved and maintained in FCC reactors by controlling the rate of flow of the regenerated catalyst from the regenerator to the reactor by means of an adjustable slide valve in the regenerator-to-reactor conduit.

The product stream or effluent of the catalytic cracker is usually fractionated into a series of products, including: gas, normally conducted to a gas treatment plant; gasoline; light cycle gas oil; and heavy cycle gas oil. A portion of the heavy cycle gas oil is usually recycled into the reactor vessel and mixed with fresh feed. The bottom effluent of the fractionator is generally allowed to settle. The solids-rich portions of the settled product is also recycled to the reactor vessel in admixture with the heavy cycle gas oil and feed.

In a modern version of the FCC reactor, the regenerated catalyst is introduced into the base of a riser reactor column in the reactor vessel. A primary purpose of the riser reactor is to crack the petroleum feed. The regenerated hot catalyst is admixed in the bottom of the riser reactor with a stream of fresh feed and recycled petroleum fractions, and the mixture is forced upwardly through the riser reactor. During the upward passage of the catalyst and of the petroleum fractions, the petroleum is cracked, and coke is simultaneously deposited on the catalyst. The coked catalyst and the cracked petroleum components are passed upwardly out of the riser and through a solid-gas separation system, e.g., a series of cyclones, at the top of the reactor vessel. The cracked petroleum fraction is conducted to a product separation unit, while the coked catalyst, after steam stripping, passes into the regenerator vessel and is regenerated therein, as discussed above. Most of the craking reactions in such modern FCC units take place in the riser reactor. Accordingly, the remainder of the reactor vessel is used primarily to separate entrained catalyst particles from the petroleum fractions.

Further details of FCC processes may be found in U.S. Pat. Nos. 4,309,279 and 4,309,280, as well as in Considine, Douglas M., Editor-in-Chief, *Energy Technology Handbook*, McGraw Hill Book Co., 1977, pp. 3-231 to 3-233, to which reference is made for a description of the FCC process.

It known that improved results will be obtained with regard to the catalytic cracking of gas oils if a crystalline zeolite having a pore size of less than 7 Angstrom units is admixed with a crystalline zeolite having a pore size greater than 8 Angstrom units, either with or without a matrix. A disclosure of this type is found in U.S. Pat. No. 3,769,202. Although the incorporation of a crystalline zeolite having a pore size of less than 7 Angstrom units into a catalyst comprising a larger pore size crystalline zeolite (pore size greater than 8 Angstrom units) has indeed been very effective with respect to raising of the octane number, nevertheless it did so at the expense of the yield of gasoline.

Improved octane number with some loss in gasoline yield was shown in U.S. Pat. No. 3,758,403. In this patent, the cracking catalyst included a large pore size crystalline zeolite (pore size greater than 7 Angstrom units) in admixture with a ZSM-5 type zeolite, wherein the ratio of the ZSM-5 type zeolite to the large pore crystalline zeolite was in the range of 1:10 to 3:1.

The use of a ZSM-5 type zeolite in conjunction with a zeolite cracking catalyst of the X or Y faujasite variety is described in U.S. Pat. Nos. 3,894,931; 3,894,933; and 3,894,934. The first two patents disclose the use of a ZSM-5 type zeolite in amounts up to and about 5 to 10 wt %; the third patent discloses the weight ratio of ZSM-5 type zeolite to large pore size crystalline zeolite in the range of 1:10 to 3:1.

The ZSM-5 type catalyst, especially virgin catalyst, has exceedingly high activity. Researchers have attempted to take advantage of the activity of fresh ZSM-5 catalyst by adding only small amounts of it to the FCC catalyst. Typical of such work is U.S. Pat. No. 4,309,280, the entire contents of which is incorporated herein by reference. This patent teaches that adding as little as 0.25 wt % ZSM-5 powder to the circulating catalyst inventory in an FCC unit would increase dry gas production by 50% (from 3.9 wt % dry gas to 6.0; see Example 6 in Table 2).

The criticality of using only minuscule amounts of a ZSM-5 type zeolite to achieve improved results with respect to octane number and overall yield has been shown in U.S. Pat. No. 4,368,114. In this patent, the minuscule quantities of the additive catalyst was shown to give the same beneficial results that were once thought obtainable only by adding much larger quantities of ZSM-5 class catalyst.

While the prior art has shown that zeolites, and in particular ZSM-5, can increase gasoline octane in cracking units, its use will be restricted if a significant gasoline yield penalty and high gas make accompany the octane gain. In this situation, only refiners who have available gas handling and lower hydrocarbon upgrading capacities will find zeolites, such as ZSM-5, attractive in their cracking operations.

Another method of increasing octane number is to raise the cracker reactor temperature. This method, however, is very limited, since many units are now operating at maximum temperatures due to metallurgical limitations. Raising the cracker reactor temperature also results in increased requirements for the gas plant (i.e., gas compressor and separator). Since most gas plants are now operating at maximum capacity, any increased load could not be tolerated by the present equipment. Further still, operating an FCC unit at high severity conditions leads to unselective cracking of many feed components.

It can be appreciated from the foregoing that an alternative method which promotes octane number increase in gasoline and pour point reduction in light fuel or distillate oils would be desirable.

OBJECTS OF THE INVENTION

It is thus an object of the invention to improve the octane number of the gasoline and the pour point of the light distillate oil produced in an FCC unit.

It is also an object of the invention to improve the octane number of the gasoline and the pour point of light distillate oil produced in an FCC unit under low severity conditions.

These and other objects are fulfilled by the present invention, which is disclosed below.

SUMMARY OF THE INVENTION

The present invention provides a process for simultaneously increasing the octane number of a gasoline fraction and improving the pour point of a light distillate oil fraction produced in a fluid catalytic cracking unit by contacting a heavy hydrocarbon feed with a conventional cracking catalyst in a fluid catalytic cracking unit under conventional catalytic conditions to produce a catalytically cracked product. The catalytically cracked product contains $C_5-$ hydrocarbons, gasoline boiling range hydrocarbons, distillate boiling range hydrocarbons, and heavier than distillate boiling range hydrocarbons. Then, preferably, the entire catalytically cracked product is directly passed to a means for contacting the catalytically cracked product with a shape-selective crystalline silicate zeolite catalyst and contacted with the shape selective catalyst under low severity conditions to obtain a dewaxed product of lower pour point and higher octane number. Then the dewaxed product is fractionated to produce at least a gasoline fraction with improved octane number and a light distillate oil with improved pour point. An apparatus for conducting the above-described process is also incorporated herein.

DETAILED DESCRIPTION OF THE INVENTION

Figure 1:
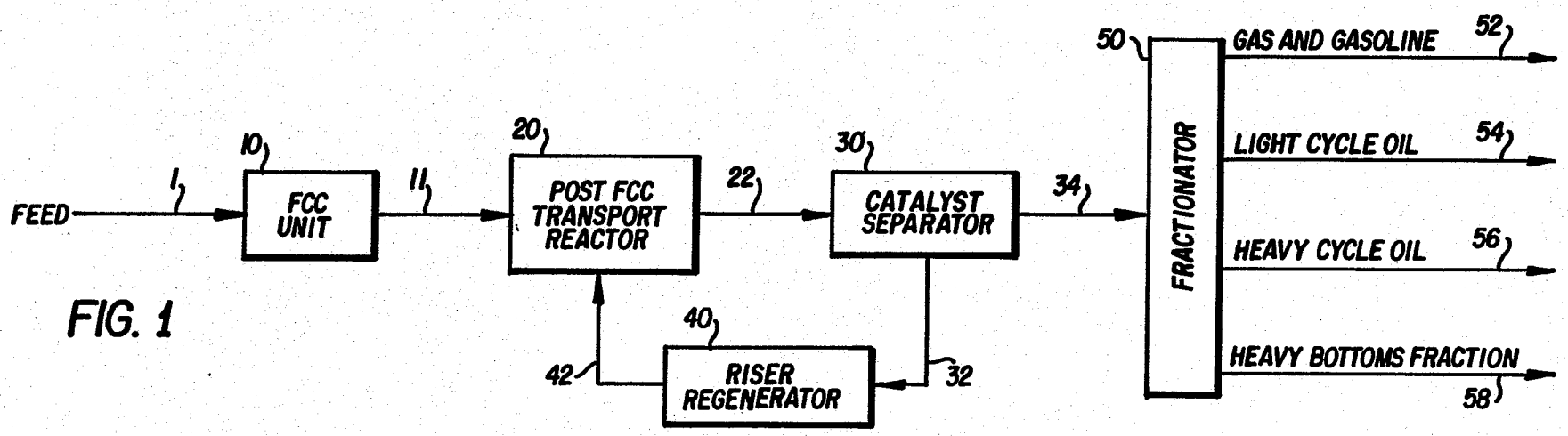
FIG. 1 is a simplified diagram of a post FCC riser process according to the present invention.

The present invention is directed to contacting an FCC effluent stream with a shape-selective catalyst at low severity conditions prior to fractionation. The term "low severity" means low conversion conditions relative to a standard FCC operation, or generally conversion conditions, as defined by loss of $C_5+$ materials, less than 10%. The FCC unit is supplemented by adding a second reactor to treat the FCC effluent by contact with a shape-selective crystalline silicate zeolite catalyst.

Feedstock

Hydrocarbon feedstocks undergoing cracking in accordance with the present invention comprise hydrocarbons generally and, in particular, petroleum fractions having an initial boiling range of at least 400° F. (205° C.), a 50% point of at least 500° F. (260° C.), and an end point of at least 600° F. (315° C.). Such hydrocarbon fractions include gas oils, residual oils, cycle stocks, whole top crudes and heavy hydrocarbon fractions derived by the destructive hydrogenation of coal, tar, pitches, asphalts, and the like. As will be recognized, the distillation of higher boiling petroleum fractions above about 750° F. (400° C.) must be carried out under vacuum in order to avoid thermocracking. The boiling temperatures utilized herein are expressed, for convenience, in terms of the boiling point corrected to atmospheric pressure.

FCC Process

The FCC process is well known to the art and a detailed description thereof is not believed necessary. Although the design and construction of the individual plants vary, the essential elements of an FC unit are illustrated in U.S. Pat. No. 4,368,114, which is incorporated herein by reference. Reference is made to the Description of the Prior Art for further disclosure of the FCC process.

Moving Bed Catalytic Cracking

Although not preferred, the process of the present invention is also directed to the utilization of a moving bed of catalytic cracking catalyst, also known as Thermofor Catalytic Cracking or TCC. This process was introduced in the early 1940's and a detailed description thereof is not believed necessary. Briefly, the process uses a moving bed of catalytic cracking catalyst. The catalyst moves from the catalytic cracking reactor to a moving bed regenerator, and from there back to the reactor. The oil chargestock, usually without added hydrogen, is passed over the moving bed of catalyst and is catalytically cracked to lighter products. During catalytic cracking, the catalyst is deactivated by coke deposition. Coke deposition is removed from the catalyst in a moving bed regenerator associated with the moving bed cracking unit.

Although the process of the present invention may be directed to a TCC unit, for purposes of description, the FCC unit will be referred to.

Post FCC Application of Catalyst

It has now been discovered that catalytic upgrading by contacting the FCC effluent stream with a shape-selective catalyst at low severity conditions prior to fractionation, several benefits in the catalytic conversion process can be obtained. By contacting the effluent with a catalyst, it has been found that the octane number of the gasoline produced is increased and the pour point of the light distillate fuel oil is decreased. Preferably, the effluent contains the entire $C_5^-$, gasoline boiling range and distillate boiling range hydrocarbons discharged from the FCC unit. The present invention avoids distilling the products from fluid catalytic cracking, to separate $C_5^-$ from the gasoline and distillate, prior to the catalytic upgrading. Thus, the present invention saves heat because it directly passes the entire cracked hydrocarbon product from FCC to catalytic upgrading.

Further, the post FCC catalyst is protected from the deactivating effects of the FCC feed coke formers and poisons, and from the high temperature cracking and regeneration. Further still, longer oil contact times can be used to facilitate the slower isomerization and hydrogen transfer reactions involved in product upgrading. An additional benefit is in the maintenance of lower severity conditions in the FCC unit in order to improve the primary cracking selectivity.

Post FCC Catalyst

The preferred catalysts for this invention are shape-selective zeolite-type catalysts. For purposes of this invention, the term "zeolite" is meant to represent the class of porotectosilicates, i.e., porous crystalline silicates, that contain silicon and oxygen atoms as the major components. Other components may be present in minor amounts, usually less than 14 mole %, and preferably less than 4 mole %. These components include aluminum, gallium, iron, boron and the like, with aluminum being preferred, and used herein for illustration purposes. The minor components may be present separately or in mixtures.

The silica-to-alumina mole ratio referred to may be determined by conventional analysis. This ratio is meant to represent, as closely as possible, the ratio in the rigid anionic framework of the zeolite crystal and to exclude aluminum in the binder or in cationic or other forms within the channels. Although zeolites with a silica-to-alumina mole ratio of at least 10 are useful, it is preferred to use zeolites having much higher silica-to-alumina mole ratios, i.e., ratios of at least 500:1. In addition, zeolites, as otherwise characterized herein but which are substantially free of aluminum, i.e., having silica-to-alumina mole ratios up to and including infinity, are found to be useful and even preferable in some instances. The novel class of zeolites, after activation, acquire an intra-crystalline sorption affinity for normal hexane, which is greater than that for water, i.e., they exhibit "hydrophobic" properties.

A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g., less than 5 Angstroms. On the other hand, zeolites which provide relatively free access to the internal zeolite structure have a low value for the Constraint Index, and usually pores of large size, e.g., greater than 8 Angstroms. The method by which Constraint Index is determined is described fully in U.S. Pat. No. 4,016,218, incorporated herein by reference for details of the method.

Constraint Index (CI) values for some typical materials are:

| | CI | (At Test Temperature) |
|---|---|---|
| ZSM-4 | 0.5 | 316° C. |
| ZSM-5 | 6–8.3 | (371° –316° C.) |
| ZSM-11 | 6–8.7 | (371° –316° C.) |
| ZSM-12 | 2.3 | (316° C.) |
| ZSM-20 | 0.5 | (371° C.) |
| ZSM-22 | 7.3 | (427° C.) |
| ZSM-23 | 9.1 | (427° C.) |
| ZSM-34 | 50 | (371° C.) |
| ZSM-35 | 4.5 | (454° C.) |
| ZSM-38 | 2 | (510° C.) |
| ZSM-48 | 3.5 | (538° C.) |
| ZSM-50 | 2.1 | (427° C.) |
| TMA Offretite | 3.7 | (316° C.) |
| TEA Mordenite | 0.4 | (316° C.) |
| Clinoptilolite | 3.4 | (510° C.) |
| Mordenite | 0.5 | (316° C.) |
| REY | 0.4 | (316° C.) |
| Amorphous Silica-Alumina | 0.6 | (538° C.) |
| Dealuminized Y (Deal Y) | 0.5 | (510° C.) |
| Erionite | 38 | (316° C.) |
| Zeolite Beta | 0.6–2 | (316° –399° C.) |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g., temperature, as to establish more than one value for the Constraint Index of a particular zeolite. This explains the range of Constraint Indices for zeolites, such as ZSM-5, ZSM-11 and Zeolite Beta.

Zeolite ZSM-4 is taught by U.S. Pat. No. 3,923,639, the disclosure of which is incorporated herein by reference.

Zeolite ZSM-5 is taught by U.S. Pat. No. 3,702,886, and Re. No. 29,949, the disclosures of which are incorporated herein by reference.

Zeolite ZSM-11 is taught by U.S. Pat. No. 3,709,979, the disclosure of which is incorporated herein by reference.

Zeolite ZSM-12 is taught by U.S. Pat. No. 3,832,449, the disclosure of which is incorporated herein by reference.

Zeolite ZSM-18 is taught by U.S. Pat. No. 3,950,496, the disclosure of which is incorporated herein by reference.

Zeolite ZSM-20 is taught by U.S. Pat. No. 3,972,983, the disclosure of which is incorporated herein by reference.

Zeolite ZSM-23 is taught by U.S. Pat. No. 4,076,342, the disclosure of which is incorporated herein by reference.

Zeolite ZSM-34 is taught by U.S. Pat. No. 4,086,186, the disclosure of which is incorporated herein by reference.

Zeolite ZSM-35 is a synthetic ferrierite-type material described by U.S. Pat. No. 4,016,245, the disclosure of which is incorporated herein by reference.

Zeolite ZSM-38 is a synthetic ferrierite-type material described in U.S. Pat. No. 4,046,859, the disclosure of which is incorporated herein by reference.

Zeolite ZSM-48 is described in U.S. Pat. No. 4,397,827, the disclosure of which is incorporated herein by reference.

Zeolite Beta is described in U.S. Pat. Nos. 3,308,069 and Re. No. 28,341, the disclosures of which are incorporated herein by reference.

U.S. patent application No. 386,456 to Valyocsik dated June 8, 1982, which is incorporated herein by reference, discloses a synthetic porous crystalline material designated as zeolite ZSM-50, a method for its preparation and to its use in catalytic conversion of organic compounds.

Low sodium Ultrastable Y molecular sieve (USY) is described in U.S. Pat. Nos. 3,293,192 and 3,449,070, the disclosures of which are incorporated herein by reference.

It is to be realized that the above CI values typically characterize the specified zeolites, but that such are the cumulative result of several variables useful in the determination and calculation thereof. Thus, for a given zeolite exhibiting a CI value within the range of 1 to 12, depending on the temperature employed during the test method within the range of 555° F. (290° C.) to 1000° F. (538° C.), with accompanying conversion between 10 and 60%, the CI may vary within the indicated range of 1 to 12. Likewise, other variables such as the crystal size of the zeolite, the presence of possibly occluded contaminants and binders intimately combined with the zeolite may affect the CI. It will accordingly be understood to those skilled in the art that the CI, as utilized herein, while affording a highly useful means for characterizing the zeolites of interest is approximate, taking into consideration the manner of its determination, with the possibility, in some instances, of compounding variable extremes. However, in all instances, at a temperature within the above-specified range of 555° F. (290° C.) to 1000° F. (538° C.), and the CI will have a value for any given zeolite of interest herein within the approximate range of 1 to 12.

Zeolites useful in the present invention are termed medium or intermediate pore zeolites and have a Constraint Index generally between 1 and 12, and an effective pore size of generally not greater than about 7 Angstroms, such as to freely sorb normal hexane. In addition, the structure must provide constrained access to larger molecules. It is sometimes possible to judge from a known crystal whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA Offretite does show some constrained access. Other 12-ring structures may exist which may be operative for other reasons, and therefore, it is not the present intention to entirely judge the usefulness of a particular zeolite solely from theoretical structural considerations.

The preferred medium pore zeolites in this invention include those having the structure of ZSM-5, ZSM-11, ZSM-12, ZSM-23, ZSM-34, ZSM-35, ZSM-48, ZSM-50, TMA Offretite and Erionite, with ZSM-5 being particularly preferred.

Another preferred zeolite catalyst is Zeolite Beta. Zeolite Beta does not have the same structure as the other preferred zeolites. However, all of these zeolites are suitable for use in the present invention.

It may be desirable to incorporate the catalyst in another material resistant to the temperature and other conditions employed in the process. Such matrix materials include synthetic and naturally occurring substances, such as inorganic material, e.g., clay, silica and metal oxides. The latter may be either naturally occurring or in the form of gelatinous precipitates or gels, including mixtures of silica and metal oxides. Naturally occurring clays can be composited with the zeolite, including those of the montmorillonite and kaolin families. The clays can be used in the raw state as originally mined or initially subjected to calcination, acid treatment or chemical modification.

Post FCC Process Conditions

The post FCC application of the aforementioned catalysts protects them from the deactivating affects of the FCC feed coke formers and poison, and from the high temperature cracking and regeneration. It also enables a longer oil contact time to be used to facilitate the slower isomerization and hydrogen transfer reactions involved in product upgrading, and allows lower severity to be maintained in the FCC unit to improve primary cracking selectivity.

The FCC effluent, comprising gasoline, light fuel oils, heavy fuel oil and unconverted bottoms, is contacted with a zeolite in the presence or absence of added hydrogen at elevated temperature and pressure. Preferably the FCC effluent further comprises $C_5-$ because it is not distilled away from the cracked FCC product until after post-FCC upgrading. Thus, after separation from FCC catalyst, the entire cracked hydrocarbon product passes, preferaby, directly from the fluid catalytic cracking reactor vessel to post-FCC upgrading to contact with the shape selective zeolite catalyst. This process is preferably conducted in the absence of added hydrogen. Temperatures are normally from 500° to 1000° F. (about 260°–538° C.), preferably 800° to 950° F. (427°–510° C.), but temperatures as low as 400° F. (204° C.) may be used for highly paraffinic feedstocks, especially pure paraffins. The use of lower temperatures tends to favor the isomerization reactions over the cracking reactions, and therefore the lower temperatures are preferred. Pressures range from atmospheric up to 100 psig. Practical considerations generally limit the pressure to a maximum of 50 psig, more usually in the range 0 to 35 psig. Space velocity (LHSV) is generally from 100 to 4000 $hr^{-1}$, more usually 200 to 2000 $hr^{-1}$.

The process may be conducted with the catalyst in a stationary bed, a fixed fluidized bed or with a transport bed, as desired.

The present process proceeds mainly by selective cracking to remove the n-paraffins from the FCC effluent to form branched chain products, with but a minor amount of isomerization. By cracking low octane n-paraffins the process of the present invention increase octane. Also this cracking produces high octane olefins.

Usually the olefins produced are slightly branched and this further increases octane. Also, simultaneously, distillate range n-paraffins are selectively cracked to reduce distillate pour point.

DETAILED DESCRIPTION OF THE DRAWINGS

Referring now to FIG. 1, which is a flow diagram disclosing a preferred embodiment of the present invention, fresh feed, usually a 650° F.+ or 750° F.+ waxy fraction, which may be preheated by exchange or, in some cases, by a fired heater (not shown), is charged via line 1 into FCC unit 10. FCC unit 10 preferably comprises a single riser cracking FCC reactor and associated catalyst regeneration unit. Within FCC unit 10, the feedstock becomes vaporized and meets a controlled stream of hot catalyst in a riser within a reactor vessel (not shown). The catalyzed oil discharges from the riser and is then separated from the catalyst by cyclones (not shown) and gaseous overhead from the cyclones is removed from FCC unit 10 via line 11 to form the FCC effluent. Thus the FCC effluent contains the $C_5-$, gasoline boiling range, distillate boiling range (light and heavy fuel oils), and unconverted bottoms discharged from the fluid catalytic cracking reactor vessel (not shown) of the FCC unit. $C_5-$ is defined as those compounds having boiling points of at most those of hydrocarbons containing 5 carbon atoms. The FCC effluent is transported via line 11 directly passed, by being, to post FCC transport reactor 20, where it is catalytically converted by the process and catalyst disclosed previously. The post FCC reactor effluent leaves post FCC transport reactor 20 via line 22 and enters catalyst separator 30, where the FCC effluent is separated from the catalyst by conventional separation techniques known to the art. The separated catalysts leaves catalyst separator 30 via line 32 and enters riser regenerator 40, where the catalyst is regenerated by conventional techniques. The regenerated catalyst is then transported to post-FCC transport reactor 20 via line 42 for further catalytic cracking. The FCC effluent, which has been separated from the catalyst, is transported from catalyst separator 30 to fractionator 50, where it is distilled into several products. The column overhead product is separated from flashing into gas and unstabilized gasoline streams 52. These overhead products are generally routed to a gas-recovery unit (not shown), in which can be produced a debutanized gasoline, a $C_3/C_4$ cut as feed for alkylation, and a fuel-gas stream containing $C_2$ and lighter components. The total cycle oil can be resolved in fractionator 50 into a light cycle oil, at line 54, which usually boils between 400° and 650° F. (204°-343° C.), for ultimate use a heating oil or diesel fuel. The heavy cycle oil, at line 56, which boils above 650° F. (343° C.) is removed as a side cut from the column, and generally recycled to the FCC unit 10. The heavy bottoms fraction, at line 58, is also generally recycled to FCC unit 10.

Figure 2:
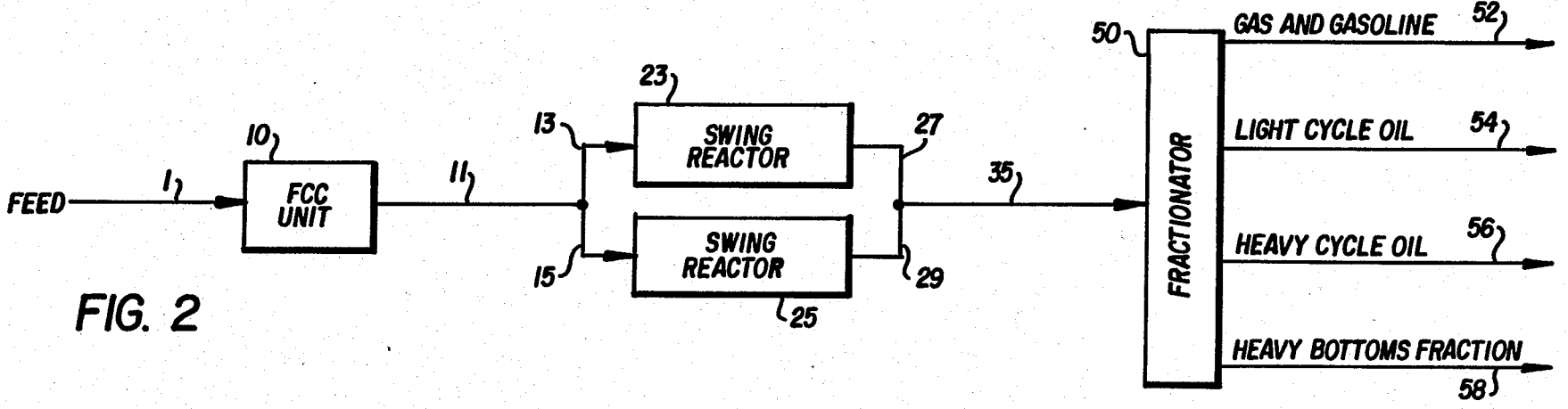
FIG. 2 is a simplified diagram of a post FCC riser process incorporating a packed bed swing reactor concept.

FIG. 2 discloses an alternative embodiment to the process of the present invention. The initial process involving FCC unit 10 is the same as in FIG. 1. The embodiment of FIG. 2 differs from FIG. 1 in that it comprises a set of swing reactors 23 and 25 through which the FCC effluent flows. Preferably, swing reactors 23 and 25 are either fixed-bed or fluidized-bed type reactors. Each reactor comprises the shape-selective zeolite catalyst as described previously. In operation, the entire FCC effluent flows directly FCC unit 10 via lines 11 and 13 into the operating swing reactor, for example, swing reactor 23, which is operated until the catalyst becomes coke-deactivated. The product of reactor 23 is transported via line 27 to line 35 for transport to fractionator 50, where the product is distilled into gas and gasoline products, light cycle oils, etc. When the catalyst in reactor 32 becomes coke-deactivated, reactor 23 is shut down and the entire FCC effluent is passed via lines 11 and 15 to reactor 25. At this point, the deactivated catalyst in reactor 23 is allowed to regenerate by means known to the art. The product of reactor 25 is passed via lines 29 and 35 to fractionator 50.

The following examples will serve to illustrate the process of the invention without limiting the same.

EXAMPLES 1-6

A debutanized $C_5+$ FCC effluent from a commercial survey was used as a feedstock to a 30" long reactor containing a suspended wire basket the length of the reactor tube. The basket was filled with 14/25 mesh crushed catalyst or mixtures of catalyst and vapor chips. Feed preheated to reaction temperature was then passed through the reactor at rates calculated to give desired residence time in the catalyst zone. Catalysts used were a 65% ZSM-5/35% alumina extruded catalyst, calcined and steam at 1000° F. (538° C.) for 2½ hours with atmospheric steam, and a 50%-Zeolite Beta/50% alumina extruded catalyst, calcined and steamed at 1000° F. (538° C.) for 16 hours with atmospheric steam. The ZSM-5 catalyst had an alpha value of 23 and the Zeolite Beta catalyst had an alpha value of 20 based on n-hexane cracking activity. The alpha value, a measure of zeolite acidic functionality, is described, together with details of its measurement, in U.S. Pat. No. 4,016,218 and in *J. Catalysis*, Vol. VI, pp. 278-287 (1966), and reference is made to these for such details. The properties of the feedstocks, as well as reaction conditions and results of the runs, are shown below in Table 1:

TABLE 1

| | $C_5+$ FCC Effluent | ZSM-5 Catalyst | | | Zeolite Beta Catalyst | | |
|---|---|---|---|---|---|---|---|
| | | Example | | | | | |
| | | 1 | 2 | 3 | 4 | 5 | 6 |
| Operating Conditions | | | | | | | |
| Cat Temp. °F. | — | 1000 | 950 | 900 | 1000 | 950 | 900 |
| Oil Res. Time (sec.) | — | 14 | 33 | 32 | 14 | 33 | 34 |
| Cat/Oil (Wt Ratio) | — | 0.22 | 0.20 | 0.40 | 0.32 | 0.31 | 0.35 |
| Product Yields (Wt %) | | | | | | | |
| $C_5+$ Gasoline | 58.7 | 50.2 | 49.0 | 47.9 | 52.6 | 52.3 | 52.5 |
| LFO | 27.4 | 27.7 | 25.5 | 27.4 | 25.6 | 24.9 | 25.3 |
| $iC_4$ | — | 0.2 | 0.5 | 0.9 | 1.0 | 1.4 | 1.4 |
| $nC_4$ | — | 0.2 | 0.4 | 0.6 | 0.3 | 0.4 | 0.3 |
| $C_4''$ | — | 1.8 | 3.0 | 2.9 | 1.6 | 1.9 | 1.5 |
| Dry Gas | — | 5.7 | 7.6 | 6.5 | 4.3 | 4.8 | 4.1 |
| Coke | — | 0.8 | 1.1 | 1.3 | 1.8 | 2.2 | 2.0 |
| $C_5+$ Gas. O.N. (R + O) | 88.7 | 90.7 | 90.4 | 90.8 | 91.0 | 91.0 | 90.6 |
| LFO Cloud Pt (°F.) | 16 | 10 | 14 | 8 | 10 | 8 | 8 |
| LFO Pour Pt (°F.) | 5 | −5 | −5 | −5 | 0 | −5 | −5 |

Table 1 contains data for four FCC effluent upgrading runs using the two zeolite catalysts, ZSM-5 and Zeolite Beta. Comparison is made to the $C_5$+ FCC effluent charge to the post FCC reactor. Zeolite Beta produces a higher octane number with less gasoline loss than ZSM-5, and the $iC_4/nC_4$ ratio of the butanes formed is higher with Zeolite Beta. Both catalysts lower the pour point of the light fuel oil (LFO) 10° and the cloud point 6°-8°.

When the $C_3$-$C_4$ olefins produced during catalytic upgrading are alkylated with isobutane, the alkylate volume made is greater than the gasoline loss during post FCC cracking. Outside isobutane is needed to alkylate all of the propylene and butylene produced. Table 2, below, illustrates this data on a volume basis for the same examples given in Table 1. As can be seen, ZSM-5 and Zeolite Beta raise octane number approximately 2.4 to 2.8 units and gasoline volume 0.6 to 4.2 vol %, including alkylate.

TABLE 2

| | $C_5$+ FCC Effluent | ZSM-5 Catalyst Example | | | Zeolite Beta Catalyst Example | | |
|---|---|---|---|---|---|---|---|
| | | 1 | 2 | 3 | 4 | 5 | 6 |
| Vol % $C_5$+ Gasoline | 64.7 | 54.6 | 53.0 | 51.8 | 57.4 | 57.1 | 57.4 |
| Vol % $C_3$ Gasoline | — | 4.2 | 5.4 | 4.8 | 2.6 | 3.4 | 3.9 |
| Vol % $C_4$ Gasoline | — | 2.5 | 4.1 | 4.1 | 2.2 | 2.6 | 2.1 |
| Vol % $iC_4$ Gasoline | — | 0.3 | 0.7 | 1.4 | 1.5 | 2.1 | 2.2 |
| Vol % Alkylate | — | 11.2 | 15.9 | 14.7 | 7.9 | 9.9 | 9.9 |
| Vol % $C_5$+ + Alkylate | — | 65.8 | 68.9 | 66.6 | 65.3 | 67.0 | 67.3 |
| Vol % Addn $iC_4$ to Alkylate | — | 7.4 | 10.1 | 8.6 | 3.9 | 4.7 | 4.7 |
| ON (R + O) $C_5$+ Gaso + Alky | 88.7 | 91.2 | 91.2 | 91.5 | 91.4 | 91.4 | 91.1 |
| Δ $C_5$+ Gaso + Alky | — | +1.1 | +4.2 | +1.9 | +0.6 | +2.3 | +2.6 |
| Δ O.N. (R + O) Gaso Pool | — | +2.5 | +2.5 | +2.8 | +2.7 | +2.7 | +2.4 |

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

I claim:

1. A process for catalytically cracking a petroleum fraction, comprising the following steps in sequence:
   (a) contacting said petroleum fraction with a cracking catalyst under catalytic cracking conditions to produce a catalytically cracked product;
   (b) directly passing said catalytically cracked product to means for contacting said catalytically cracked product with a shape-selective crystalline silicate zeolite catalyst, and contacting said cracked product with said shape-selective catalyst under conditions to produce a product comprising a gasoline fraction having a higher octane number and comprising a light distillate oil fraction having a lower pour point than said catalytically cracked product; and
   (c) fractionating said product of step (b) to produce at least said gasoline fraction with improved octane number and said light distillate oil fraction with improved pour point.

2. The process of claim 1, wherein step (a) is conducted in a fluid catalytic cracking reactor.

3. The process of claim 1, wherein said shape-selective zeolite is selected from the group having the structure of ZSM-5, ZSM-11, ZSM-12, ZSM-23, ZSM-34, ZSM-35, ZSM-38, ZSM-48, ZSM-50, TMA Offretite and Erionite.

4. The process of claim 1, wherein said shape-selective zeolite is ZSM-5.

5. The process of claim 1, wherein said shape-selective zeolite is Zeolite Beta.

6. The process of claim 1, wherein said catalytically cracked product is contacted with a shape-selective crystalline silicate zeolite at a temperature of 800° to 950° F., a pressure from atmospheric to 100 psig, and a space velocity LHSV of 100 to 4000.

7. The process of claim 1, wherein said shape-selective crystalline silicate zeolite comprises 65 wt % ZSM-5 and 35 wt % alumina, wherein said ZSM-5 has an alpha value of approximately 23.

8. The process of claim 1, wherein said shape-selective crystalline silicate zeolite comprises 50 wt % Zeolite Beta and 50 wt % alumina, wherein said Zeolite Beta has an alpha value of about 20.

9. The process of claim 1, wherein said catalytically cracked product is contacted with said shape-selective crystalline zeolite for a time between 14 and 34 seconds.

10. The process according to claim 1, wherein the catalytically cracked product is contacted with the shape-selective crystalline silicate zeolite catalyst in the absence of added hydrogen.

11. A process for simultaneously increasing the octane number of a gasoline fraction and improving the pour point of a light distillate oil fraction produced in a fluid catalytic cracking unit, comprising:
   (a) contacting a heavy hydrocarbon feed with a cracking catalyst in a fluid catalytic cracking unit under catalytic cracking conditions to produce a catalytically cracked product;
   (b) directly passing said catalytically cracked product to means for contacting said catalytically cracked product with a shape-selective crystalline silicate zeolite catalyst, and contacting said cracked product with said shape-selective catalyst under conditions to produce a product comprising a gasoline fraction having a higher octane number and comprising a light distillate oil fraction having a lower pour point than said catalytically cracked product; and
   (c) fractionating said product of step (b) to produce at least said gasoline fraction with improved octane number and said light distillate oil fraction with improved pour point.

12. The process of claim 11, wherein said shape-selective zeolite is selected from the group having the structure of ZSM-5, ZSM-11, ZSM-12, ZSM-23, ZSM-34, ZSM-35, ZSM-38, ZSM-48, ZSM-50, TMA Offretite and Erionite.

13. The process of claim 11, wherein said shape-selective zeolite is ZSM-5.

14. The process of claim 11, wherein said shape-selective zeolite is Zeolite Beta.

15. The process of claim 11, wherein said catalytically cracked product is contacted with a shape-selective crystalline silicate zeolite at a temperature of 800° to 950° F., a pressure from atmospheric to 100 psig, and a space velocity LHSV of 100 to 4000.

16. The process according to claim 11, wherein the catalytically cracked product is contacted with the shape-selective crystalline silicate zeolite catalyst in the absence of added hydrogen.

17. A process for catalytically cracking a petroleum fraction comprising the steps of, contacting said petroleum fraction with a cracking catalyst in a fluid catalytic cracking unit under cracking conditions to produce a catalytically cracked product, fractionating said catalytically cracked product under fractionating conditions, directly passing said cracked product to means for contacting said catalytically cracked product with a shape-selective crystalline silicate zeolite catalyst, prior to said fractionating, and contacting said cracked product with said shape-selective catalyst under conditions comprising a temperature of 800° to 950° F., a pressure for atmospheric to 100 psig, and a space velocity, LHSV of 100 to 4000, to produce a product comprising a gasoline fraction having a higher octane number and comprising a light oil distillate fraction having a lower pour point than comparably boiling gasoline and light oil distillate fractions, respectively, of said catalytically cracked product prior to said contacting with said shape-selective catalyst.

18. The process of claim 17, wherein said shape-selective zeolite is selected from the group having the structure of ZSM-5, ZSM-11, ZSM-12, ZSM-23, ZSM-34, ZSM-35, ZSM-38, ZSM-48, ZSM-50, TMA Offretite and Erionite.

19. The process of claim 17, wherein said shape-selective zeolite is ZSM-5.

20. The process of claim 17, wherein said shape-selective zeolite is Zeolite Beta.

21. The process according to claim 17, wherein the catalytically cracked product is contacted with the shape-selective crystalline silicate zeolite catalyst in the absence of added hydrogen.

22. A process for catalytically cracking a petroleum fraction, comprising the following steps in sequence:

(a) contacting said petroleum fraction with a cracking catalyst under catalytic cracking conditions to produce a catalytically cracked product comprising gasoline boiling range and distillate boiling range hydrocarbons;

(b) contacting said gasoline and distillate boiling range hydrocarbons of said catalytically cracked product with a shape-selective crystalline silicate zeolite catalyst under dewaxing conditions to produce a dewaxed product; and (c) fractionating said dewaxed product to produce at least a gasoline fraction with improved octane number and a light distillate oil with improved pour point relative, respectively, to said gasoline boiling range hydrocarbons and a comparably boiling distillate oil fraction of said catalytically cracked product prior to said contacting with shape selective catalyst.

23. The process of claim 22, wherein step (a) is conducted in a fluid catalytic cracking reactor.

24. The process of claim 22, wherein said shape-selective zeolite is selected from the group having the structure of ZSM-5, ZSM-11, ZSM-12, ZSM-23, ZSM-34, ZSM-35, ZSM-38, ZSM-48, ZSM-50, TMA Offretite and Erionite.

25. The process of claim 22, wherein said shape-selective zeolite is ZSM-5.

26. The process of claim 22, wherein said shape-selective zeolite is Zeolite Beta.

27. The process of claim 23 wherein said catalytically cracked product is contacted with said shape-selective crystalline silicate zeolite at a temperature of 800° to 950° F., a pressure from atmospheric to 100 psig, and a space velocity, LHSV of 100 to 4000.

28. The process of claim 27, wherein said shape-selective crystalline silicate zeolite comprises 65 wt % ZSM-5 and 35 wt % alumina, wherein said ZSM-5 has an alpha value of approximately 23.

29. The process of claim 27, wherein said shape-selective crystalline silicate zeolite comprises 50 wt % Zeolite Beta and 50 wt % alumina, wherein said Zeolite Beta has an alpha value of about 20.

30. The process of claim 27, wherein said catalytically cracked product is contacted with said shape-selective crystalline zeolite for a time between 14 and 34 seconds.

* * * * *